US005293801A

United States Patent [19]

Dritenbas

[11] Patent Number: 5,293,801

[45] Date of Patent: Mar. 15, 1994

[54] SYSTEMS FOR PRODUCING TRUSS MEMBERS

[76] Inventor: Jack U. Dritenbas, 7985 Oslo Rd., Vero Beach, Fla. 32968

[21] Appl. No.: 848,068

[22] Filed: Mar. 9, 1992

[51] Int. Cl.[5] ..... B27B 5/18

[52] U.S. Cl. ..... 83/468.3; 83/486.1; 83/522.11; 83/468.4

[58] Field of Search ..... 83/468.3, 468, 522.11-522.19, 83/522.25, 486.1, 761, 581, 468.4, 486; 33/534, 424, 425, 456, 465, 471, 473, 526, DIG. 16

[56] References Cited

U.S. PATENT DOCUMENTS

| | | | |
|---|---|---|---|
| 1,767,012 | 6/1930 | Pfau | 83/486 |
| 2,606,580 | 8/1952 | Johnson | 83/522.18 |
| 2,894,543 | 7/1959 | Ivy, Jr. | 83/437 |
| 3,302,669 | 2/1967 | Edler | 83/468.1 |
| 3,842,700 | 10/1974 | Novak | 83/522.17 |
| 4,939,968 | 7/1990 | Stoof | 83/468 |
| 4,974,306 | 12/1990 | Cole et al. | 83/468 |
| 5,050,473 | 9/1991 | Ingram et al. | 83/468.3 |

*Primary Examiner*—Richard K. Seidel
*Assistant Examiner*—Allan M. Schrock
*Attorney, Agent, or Firm*—Carroll F. Palmer

[57] ABSTRACT

An adaptable system for precise cutting ends of 2×4 type lumber to form chords and webs for wooden roof trusses basically includes (a) a protractor unit formed of a plate member and a guide member, (b) horizontal table means including an upper surface supporting the protractor unit and upon which the lumber is supported in use of the system and (c) a radial arm saw. Stucture details of the protractor unit are disclosed. The system is relatively much less expensive than prior known precision roof truss member cutting devices and its method of use is quickly learned by sawyers.

8 Claims, 3 Drawing Sheets

SYSTEMS FOR PRODUCING TRUSS MEMBERS

BACKGROUND OF THE INVENTION

1. Field of the Invention

This application relates to devices for production of truss members. More particularly, it concerns relatively inexpensive devices for precision cutting the ends of lumber to form chords and webs for fabrication of wood trusses.

2. Description of the Prior Art

Consideration of the recent past and probable future of new home construction indicates a continuing desire by would-be home buyers to purchase homes with such outstanding features as volume ceilings of every conceivable design. In contrast to residential building home designs up to a few years ago, with the advent of in house computer designs and engineering, virtually any roof truss design is now limited only to one's imagination. Architects, builders and would-be owners now and for the foreseeable future demand buildings that require roof trusses involving a wide spectrum of chord and web angles, not at all like the identical, "cookie cutter" trusses that were typical of the building designs prior to this new trend in computerized building design and construction. However, the cutting and fabricating end of the roof truss industry is falling behind the trend in this truss design revolution.

Basically, with few exceptions, the truss fabricating manufacturers continue to cut and assemble roof trusses as they have for 20 or more years. In the years from the early 1950's to the early 1980's, flat ceilings with low pitched roofs provided little challenge to design, cutting and fabrication methods. Many truss fabrication shops relied almost entirely on radial arm saws for most of the cutting needs. As a change, a popular introduction was the "component saw", consisting of 4 or more saw blades capable of making multiple angled cuts to each piece of lumber fed in rapid succession thru the machine. Although the set up time in the use of this type saw is slow and requires rechecking, the time spent can be justified when making a good number of identical pieces. However, the component saws are large, needing approximately 14'×60' of floor space, and very expensive. Hence, this type machine is designed for high volume, repetitive member design trusses. Other similar type saws came onto the market to fulfil the need for high rate production of "cookie cutter" kind of trusses. In today's market of one-of-a-kind (OOAK) truss designs, requiring few repetitive webs and chords for a given building, the component saws for producing "cookie cutter" trusses are sitting idle much of the time since demand for this type trusses are now becoming a rarity.

In view of the situation discussed above, there exists a need for power-saw devices that can produce OOAK type trusses without need for arduous set-up and recheck routines and, particularly, such devices that are low in cost to purchase and maintain.

There are some saw devices on the market today designed to handle the OOAK trusses. These saws (which are basically a modified radial arm saw mounted to a specially designed cutting table) are fast in set-up time and cutting, but these saws are very expensive.

It is known to use protractors in conjunction with power saws to guide them in the cutting of wood, plastics or the like as disclosed in U.S. Pat. Nos. 2,803,271, 4,320,678, 4,608,898 and 4,945,799, but the devices so disclosed are not capable of effective use in the production of OOAK roof trusses.

OBJECTS

A principal object of the invention is the provision of improved devices for production of wood truss members.

Further objects include the provision of:

1. Relatively inexpensive devices for precision cutting the ends of lumber to form chords and webs for fabrication of roof trusses.

2. Systems for production of chords and webs of OOAK building trusses that are relatively inexpensive as compared with currently available devices for such production because these new systems utilize a conventional radial arm saw which is already part of the equipment possessed by substantially every truss manufacturing plant.

3. Systems as aforesaid that do not require the radial arm of the saw to swing into different positions to perform the cutting of ends of lumber in order to produce truss webs or chords having high precision, angled ends.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a system for cutting ends of 2×4 type lumber to form chords and webs of building trusses which basically comprises (a) a protractor unit, (b) horizontal table means having a first longitudinal axis and including an upper surface supporting the protractor unit and upon which the lumber is supported in use of the system, and (c) a radial ann saw including a horizontal arm having a second longitudinal axis and a circular saw blade carried by the arm to be manually moved along the second longitudinal axis above the upper surface, the horizontal arm being fixed in the use of the system so the second longitudinal axis is normal to the first longitudinal axis.

The term 2×4 type lumber as used herein and the appended claims is intended to include similar lumber used in wooden truss construction including 2×6 lumber of any required length form which to form the desired web or chord.

The protractor unit comprises a plate member and a guide member.

The plate member is defined by a top surface, a bottom surface, a longitudinal side, a second side opposed to the longitudinal side, a third side normal to the longitudinal side and a fourth side opposed to the third side.

The plate member has a radial slot therein extending through the top and bottoms surfaces with indices adjacent the slot marking degrees of arc subtended by the radial slot. The truss industry uses the measuring system of feet, inches and 16ths, e.g., 6'-2-12 is 6'-2-12/16 or 6'-2-3/4", while all angles are in degrees. Hence, the indices on the plate member are degree angles, e.g., a square cut is 90° for Clary and 0° for IDACO.

The guide member comprises an arm portion and a stop portion.

The arm portion comprises an elongate plate having a major longitudinal axis and a minor transverse axis. Such plate is defined by a top surface, a bottom surface, first and second opposed longitudinal edges and first and second opposed transverse edges. Further, the plate has at least three straight slots, preferably angled, extending through its the top and bottom surfaces and parallel with spaced apart from each other adjacent the first opposed longitudinal edge.

The arm portion plate is pivoted adjacent the first transverse edge upon the plate member at a pivot point adjacent the longitudinal side of the plate member to permit the arm portion to swing across the top surface of the plate member. Lock means is associated with the radial slot to enable the arm portion to be locked into selected positions relative to the indices. Preferably the lock means is a bolt extending through the radial slot and a knurled knob threaded on the bolt.

The stop portion comprises a right-angle, elongate fence member having a length substantially equal to the distance between the first and second transverse sides and a plurality of locking screw units, equal in number to the straight slots, are associated with the straight slots to enable the fence member to be moved along the minor transverse axis and be fixed at selected positions relative to the first transverse side. Preferably, each locking screw unit is a bolt extending through one of the straight slots and a knurled knob threaded on the bolt.

Stop elements are fixed to the top surface of the plate member to limit the degree of arc through which the guide member can swing. A lug to engage one of the stop elements extends from the second longitudinal edge.

The arm portion carries a pointer so the guide member may be precisely located at a selected index of the indices. Preferably, the pointer is an angular lug extending from the first longitudinal edge.

BRIEF DESCRIPTION OF THE DRAWINGS

A more complete understanding of the invention can be obtained by reference to the accompanying drawings in which.

DESCRIPTION OF THE PREFERRED EMBODIMENTS

Referring in detail to the drawings, the new system 2 for production of building trusses comprises a protractor unit 4, horizontal table means 6 and radial arm saw 8.

Figure 1:
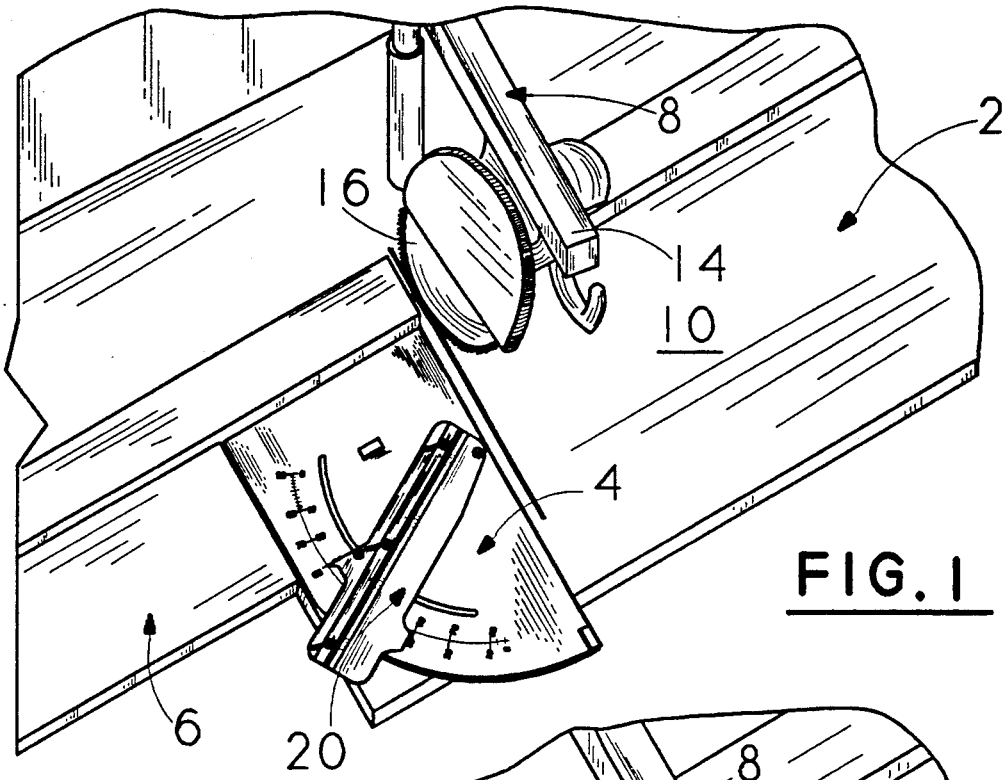
FIG. 1 is fragmentary, isometric view of a system for cutting of roof truss members in accordance with the invention.
Figure 2:
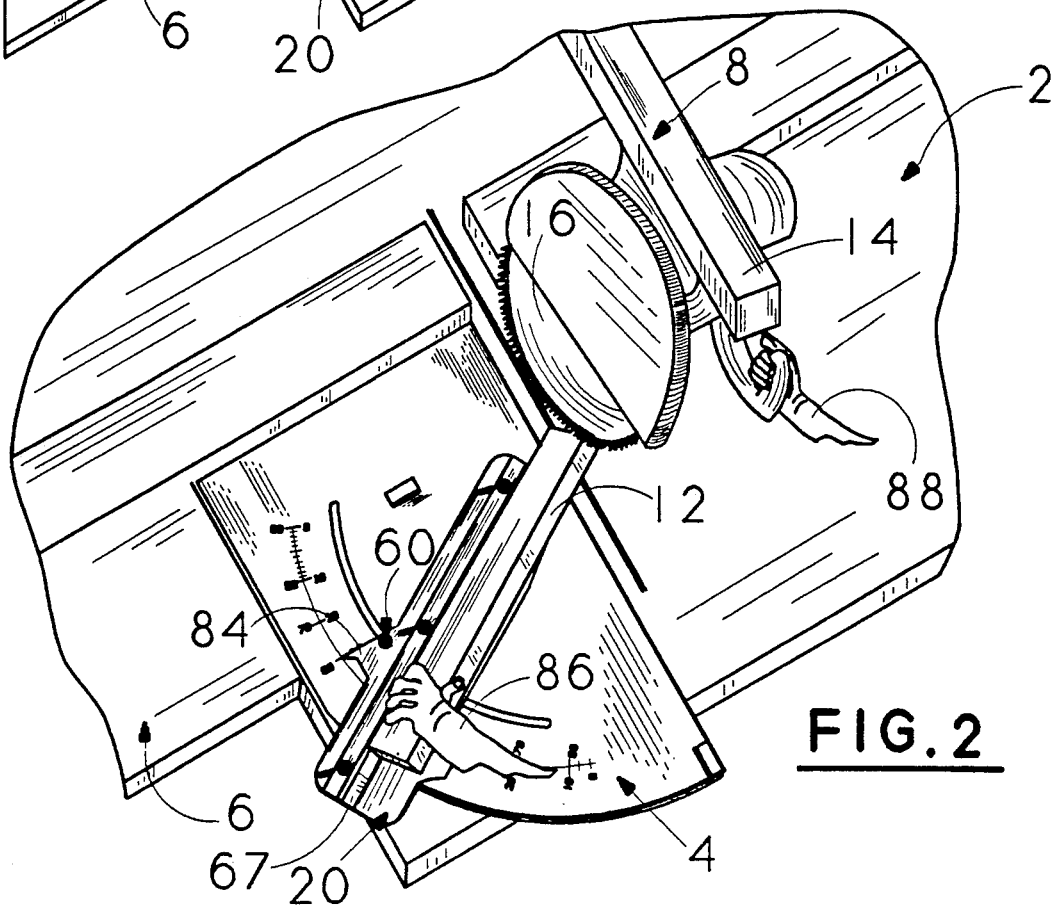
FIG. 2 is an enlarged, fragmentary, isometric view of the system of FIG. 1 showing it in use of cutting of a truss web.

Horizontal table means 6 includes upper surface 10 which supports the protractor unit 4 and upon which lumber 12 is supported in use of the system (FIG. 2).

The radial arm saw 8 includes a horizontal arm 14 and a circular saw blade 16 is carried by the arm 14 to be manually moved along it normal to the longitudinal axis of the surface 10.

The protractor unit 4 comprises a plate member 18 and a guide member 20.

The plate member 18 is defined by a top surface 22, a bottom surface 24, a longitudinal side 26, a second side 28, a third side 30 and a fourth side 32. Typically, member 18 measures 20½"×31½", but different dimensions may be used as can other side configurations, e.g., second side 28A and fourth side 32A.

There is a radial slot 34 in the plate member 18 that extends through the top and bottom surfaces 22 & 24. Indices 36 are printed or engraved in surface 22 adjacent the slot 34 marking degrees of arc subtended by the slot. The indices are 90°-8' for Clary set ups and corresponding 0°-82° for IDACO.

The guide member 20 comprises an arm portion 38 and a stop portion 40.

Figure 3:
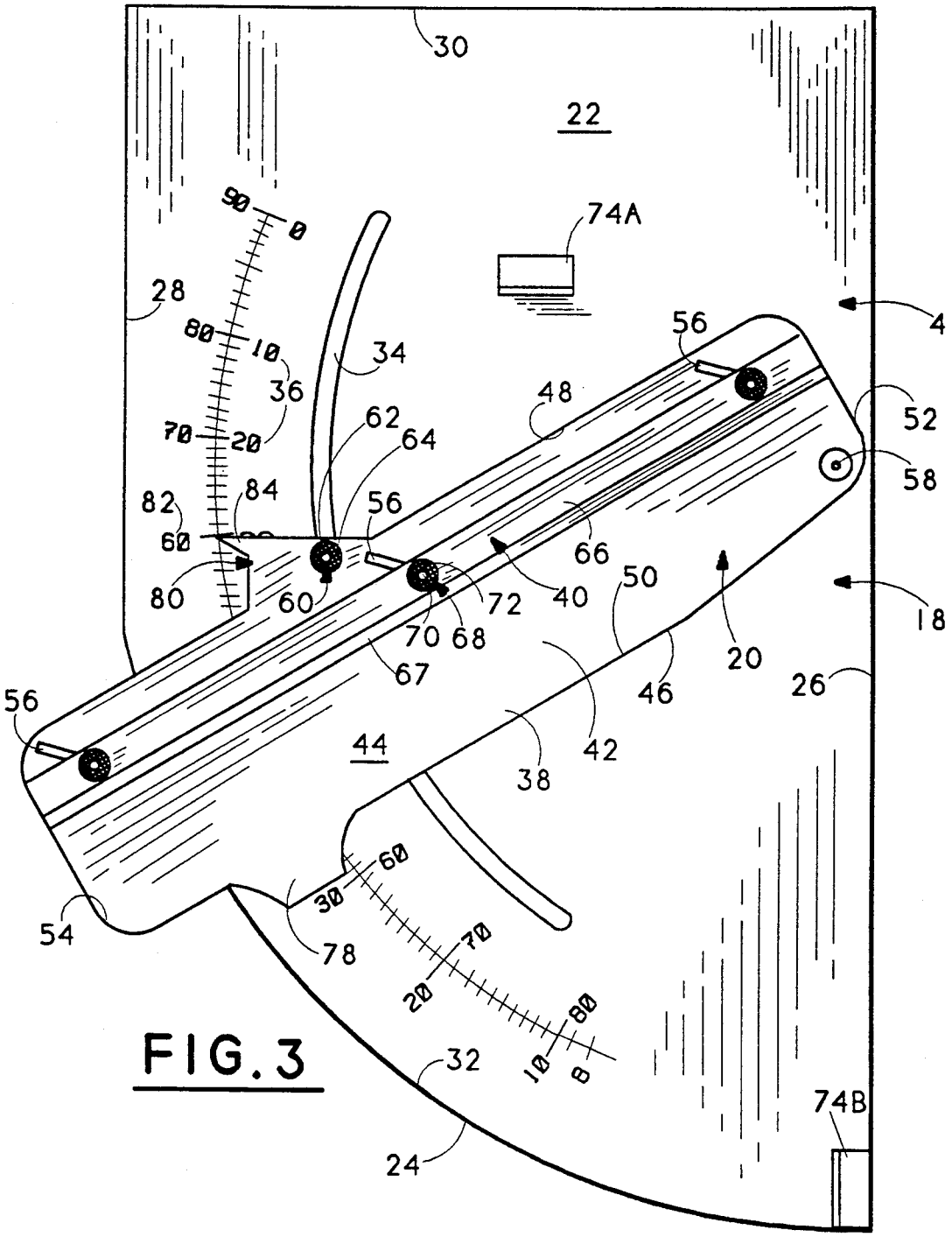
FIG. 3 is a plan view of the protractor member of the truss production system of FIG. 1.
Figure 4:
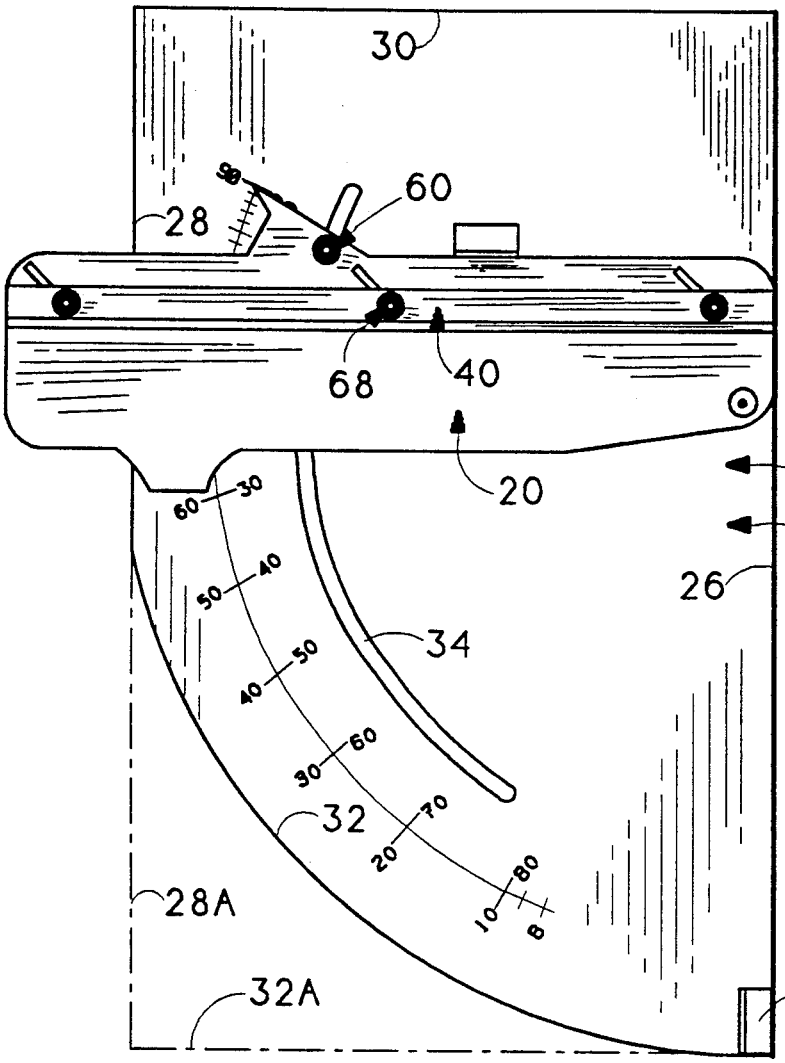
FIG. 4 is another plan view of the protractor member of FIG. 3.
Figure 6:
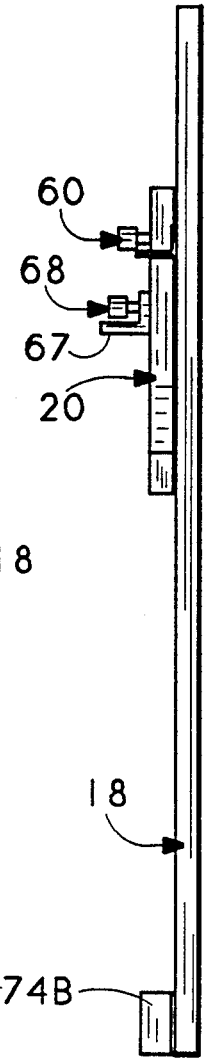
FIG. 6 is a lateral view of the protractor member as shown in FIG. 4.
Figure 5:
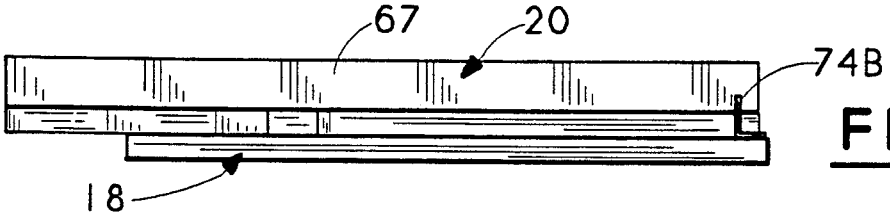
FIG. 5 is an end view of the protractor member as shown in FIG. 4.

The arm portion 38 comprises an elongate plate 42 that includes a top surface 44, a bottom surface 46, first and second longitudinal edges 48 & 50 and first and second transverse edges 52 & 54. Three straight, angled slots 56 extend through the top and bottom surfaces 44 & 46. These slots 56 enable the stop portion 40 to be moved to accomodate either 2×4 or 2×6 lumber. Thus, with 2×4s the stop portion 40 is positioned as seen in FIG. 3, but is moved to the other ends of the slots 56 when 2×6s are to be cut.

The plate 38 is pivoted, such as by a flush pin 58, adjacent the side 26 of the plate member 18 to permit the arm portion to swing across the top surface 22.

Lock means 60 comprises a bolt 62 that extends through the radial slot 34 and a knurled knob 64.

The stop portion 40 comprises a fence member 66 having a vertical lumber engagement face 67 and three screw units 68 comprising a bolt 70 extending through a straight slot 56 and a knurled knob 72 threaded on the bolt 70.

Stop elements 74A & 74B are fixed, such as by welding, to the top surface 22 of plate member 18 to limit the degree of arc through which the guide member 20 can swing. A lug 78 to engage stop element 74B extends from the edge 50 of plate 42.

The arm portion 20 carries a pointer 80 so guide member 20 may be precisely located at a selected index 82 of the indices 36. As shown, the pointer 80 is an angular lug 84 extending from the longitudinal edge 48.

Figure 7:
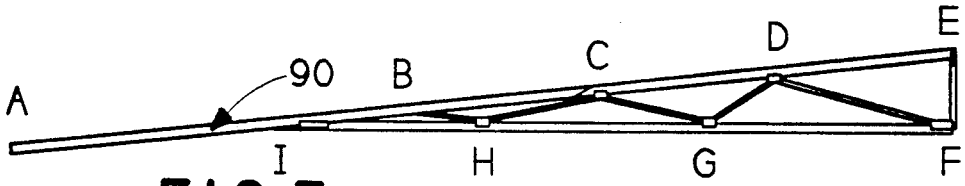
FIG. 7 is a lateral view of a representative OOAK truss that can be produced with the new systems of the invention.

Use of the new truss production system 2 can be explained with reference to FIGS. 2 and 7 with the assumption that a truss 90 is to be produced by cutting 2×4 lumber. The top chord is formed of two pieces A-C of length 14-0 and C-E (10-4-9) while the bottom chord is one piece F-I (17-10-8). There are six webs B-H (1-10-5), C-H (3-2-14), C-G (3-2-14), D-G (2-5-13), D-F (4-7-13) and E-F (2-8-12). Without listing all angles to be cut for all these pieces, by way of example web D-F would have its left end cut at an angle of 31.7, to face the chord and an angle of 64.81 to face the other web and have its right end cut at an angle of 25.2, to face the lower chord and an angle of 64.8' to face the other web.

To produce the web D-F, the lock means 60 is first unlocked, the pointer 84 of protractor unit is moved to the index for a 34.6' cut and the lock means 60 is locked.

Then, the piece of 2×4 lumber 12, previously cut to a length of 4 ft. 7 13/16 in., is placed on the protractor means 4 with its distal vertical edge against the stop wall 67 and with its right hand end under the saw blade 16 as shown in FIG. 2. With saw 8 turned on and the sawyer's left hand 86 holding the lumber 12, the saw blade 16 is pulled forward with the right hand 88 to cut a triangular piece off the lumber 12. Next, the protractor pointer 84 is relocated to the index for a 64.8° cut, lumber 12 is turned over and a new cut made on the previously cut end. To finish the web, the lumber 12 is turned end-for-end and its second end is twice cut in like manner to angles 64.8° and 25.2°. This procedure is then repeated to cut required angles on the ends of the remaining three chord lumber sections and five webs. Finally, the cut chords and webs are assembled in conventional manner with fasteners into the desired truss 90.

I claim:

1. A system for cutting ends of lumber to form chords and webs of building trusses which comprises:

a protractor unit, horizontal table means having a first longitudinal axis and including an upper surface supporting said protractor unit and upon which said lumber is supported in use of said system, and a radial arm saw including a horizontal arm having a second longitudinal axis and a circular saw blade carried by said arm to be manually moved along said second longitudinal axis above said upper surface, said horizontal arm being fixed so that said second longitudinal axis is normal to said first longitudinal axis, said protractor unit comprising:

a plate member defined by a top surface, a bottom surface, a longitudinal side, a second side opposed to said longitudinal side, a third normal to said longitudinal side and a fourth side opposed to said third side, said plate member having a radial slot therein extending through its thickness with indices positioned adjacent said slot marking degrees of an are substended by said radial slot, a guide member comprising an arm portion and a stop portion, said arm portion comprising an elongate plate having a major longitudinal axis and a mirror transverse axis, said plate defined by a top surface, a bottom surface, first and second opposed longitudinal edges and first and second opposed transverse edges, said plate having at least three straight slots extending through its thickness spaced apart from and parallel with each other adjacent said first opposed longitudinal edge, said arm portion plate being pivoted adjacent said first opposed transverse edge upon said plate member at a pivot point adjacent said longitudinal side of said plate member to permit said arm portion to swing across said top surface of said plate member, lock means associated with said radial slot to enable said arm portion to be locked into selected positions relative to said indices, and said stop portion comprising a right-angle, elongate fence member having a length substantially equal to the distance between said first and second transverse edges and a plurality of screw units disposed in and equal in number to said straight slots to enable said fence member to be moved along said minor transverse axis and be fixed at selected positions relative to said first transverse side.

2. The system of claim 1 wherein stop elements are fixed to said top surface of said plate member to limit the degree of arc through which said guide member can swing.

3. The system of claim 2 wherein a lug to engage one of said stop elements extends from said second longitudinal edge.

4. The system of claim 2 wherein said top elements are right-angle stops.

5. The system of claim 1 wherein said arm portion carries a pointer whereby said guide member may be precisely located at a selected index of said indices.

6. The system of claim 5 wherein said pointer is an angular lug extending from said first longitudinal edge.

7. The system of claim 1 wherein said lock means is a bolt extending through said radial slot and a knurled knob threaded on said bolt.

8. The system of claim 1 wherein each said screw unit is a bolt extending through one of said straight slots and a knurled knob threaded on said bolt.

* * * * *